US006010393A

United States Patent [19]

Kawase et al.

[11] Patent Number: 6,010,393

[45] Date of Patent: Jan. 4, 2000

[54] METHOD OF PRODUCING ELECTRONIC DEVICES WITH UNIFORM RESISTANCE VALUES

[75] Inventors: Masahiko Kawase; Ikuya Taniguchi; Ryoichi Urahara; Norimitsu Kitoh, all of Shiga, Japan

[73] Assignee: Murata Manufacturing Co., Ltd., Kyoto, Japan

[21] Appl. No.: 09/032,474

[22] Filed: Feb. 26, 1998

[30] Foreign Application Priority Data

Mar. 10, 1997 [JP] Japan ..... 9-055049

[51] Int. Cl.[7] ..... B24B 1/00

[52] U.S. Cl. ..... 451/41; 451/8; 451/41; 29/25.41; 29/25.42; 29/610.01

[58] Field of Search ..... 451/8, 41; 29/25.41, 29/25.42, 610.01

[56] References Cited

U.S. PATENT DOCUMENTS

| | | | |
|---|---|---|---|
| 3,648,132 | 3/1972 | Rayburn | 317/261 |
| 3,665,570 | 5/1972 | Brooks | 29/25.42 |
| 5,317,341 | 5/1994 | Tatsumi | 346/76 |
| 5,680,685 | 10/1997 | Bischoff | 29/25.42 |

*Primary Examiner*—David A. Scherbel
*Assistant Examiner*—Shantese McDonald
*Attorney, Agent, or Firm*—Majestic, Parsons, Siebert & Hsue P.C.

[57] ABSTRACT

After a plurality of electronic devices such as thermistor elements are produced, each having electrodes formed on the surface of a ceramic body, they are separated into groups according to their measured resistance values. Those with resistance values smaller than a specified allowable range are repaired, having their electrodes abraded such that their resistance values are increased and brought into the specified allowable range.

8 Claims, 3 Drawing Sheets

METHOD OF PRODUCING ELECTRONIC DEVICES WITH UNIFORM RESISTANCE VALUES

BACKGROUND OF THE INVENTION

This invention relates to a method of producing electronic devices having electrodes formed on the surface of a ceramic body and in particular to a method of producing such electronic devices including the step of correcting the resistance values of the produced electronic device.

FIG. 5 shows a thermistor element 11 as an example of prior art electronic device, having electrodes 13 and 14 formed on the two main surfaces of a thermistor body 12 comprising a ceramic material with negative temperature characteristic comprising several kinds of transition metal oxides. To produce such thermistor elements, a mother thermistor wafer is prepared first and cut into many parts. In other words, a mother wafer with a relatively large surface area is prepared first, electrodes are formed all over its main surface, and this mother thermistor wafer is cut, say, by a dicing process, according to the specified size of the thermistor elements 11.

Like other kinds of resistor elements, however, thermistor elements must have their resistance values within a specified target range according to a product standard. On the other hand, the resistance values of produced thermistor elements usually vary because of the non-uniformity not only in the resistance value of the thermistor body material but also in the size of the diced elements. Thus, there have been efforts both to reduce the variations in the material and to improve accuracy in dicing.

In spite of all such efforts, however, it is difficult to make the variations in the resistance value of produced thermistor elements extremely small. In fact, there were always not a few with resistance values outside the allowable range mixed among produced thermistor elements. In other words, the fraction of acceptable products was not sufficiently high and the efforts to reduce the production cost of thermistor elements have not been successful.

SUMMARY OF THE INVENTION

It is therefore an object of this invention to provide a method of more dependably producing electronic devices with their resistance values within a specified range and to thereby improve the fraction of good products and to reduce the overall production cost.

A method according to this invention of producing electronic devices having uniform resistance values, with which the above and other objects can be accomplished, may be characterized as comprising the steps of measuring the resistance values of electronic devices each having electrodes on the surface of a ceramic body, separating the measured devices into groups according to the relative magnitude of their resistance values such that at least one of the groups contains devices with resistance values smaller than a specified allowable range, and abrading end surfaces of the electrodes in such group or groups of devices with smaller resistance values so as to increase their resistance values into the specified allowable range. According to a preferred embodiment of the invention, when these electronic devices are originally prepared, they are each designed to have a target resistance value which is smaller than the center resistance value of the aforementioned specified allowable range such that the distribution curve of the resistance values will most probably have a central maximum somewhere on the lower side of the specified allowable range. This invention is particularly effective if the aforementioned electronic devices are resistance-providing elements such as ordinary resistors or temperature-sensitive resistance elements including NTC and PTC thermistors.

BRIEF DESCRIPTION OF THE DRAWINGS

The accompanying drawings, which are incorporated in and form a part of this specification, illustrate an embodiment of the invention and, together with the description, serve to explain the principles of the invention. In the drawings.

DETAILED DESCRIPTION OF THE INVENTION

In what follows, the invention is described by way of an example but this example is not intended to limit the scope of the invention.

Let us assume that the allowable range of resistance values for thermistor elements to be produced is give as R±a with R representing the center of the allowable range. In this case, thermistor elements are produced with their resistance values aimed to be R−a, which is smaller than the center value R. A plurality of thermistor elements are thus produced initially by a prior art method of cutting a mother thermistor wafer into parts.

Figure 2:
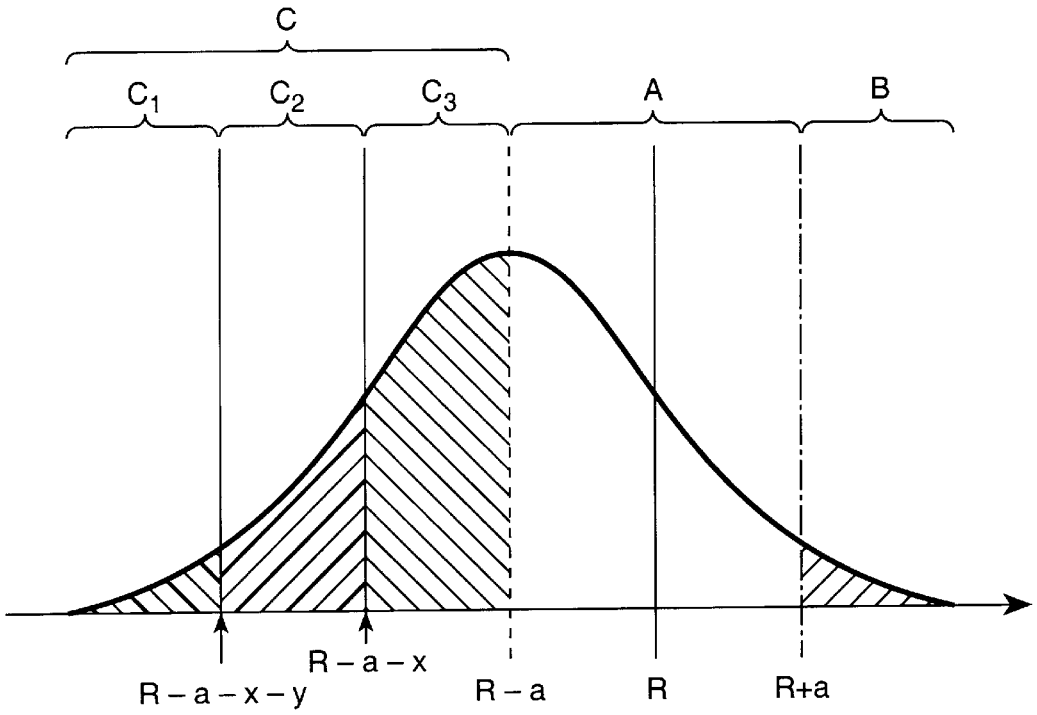
FIG. 2 is a graph of distribution in resistance value obtained during a step in a method according to this invention.

Next, the resistance value between the two electrodes is measured of each of the thermistor elements thus obtained, and the plurality of thermistor elements thus measured are sorted into groups as follows according to their measured resistance values. FIG. 2 schematically shows how the measured resistance values would typically be distributed, its horizontal axis indicating the resistance value and its vertical axis indicating the number of thermistor elements having the corresponding resistance value. Since these thermistor elements were intended to have the resistance value of R−a, this would typically be the center of the distribution curve. The range from R−a to R+a, indicated by letter "A" represents thermistor elements which are acceptable, and hence these thermistor elements are separated out as "good products." Those having resistance values greater than R+a are separated out as being in Group "B" and those having resistance values less than R−a are separated out as being in Group "C." According to this invention, a "repair work" is carried out only on those thermistor elements in Group "C" and it is done by a barrel abrasion process because a plurality of thermistor elements can be efficiently abraded by this process.

Figure 1:
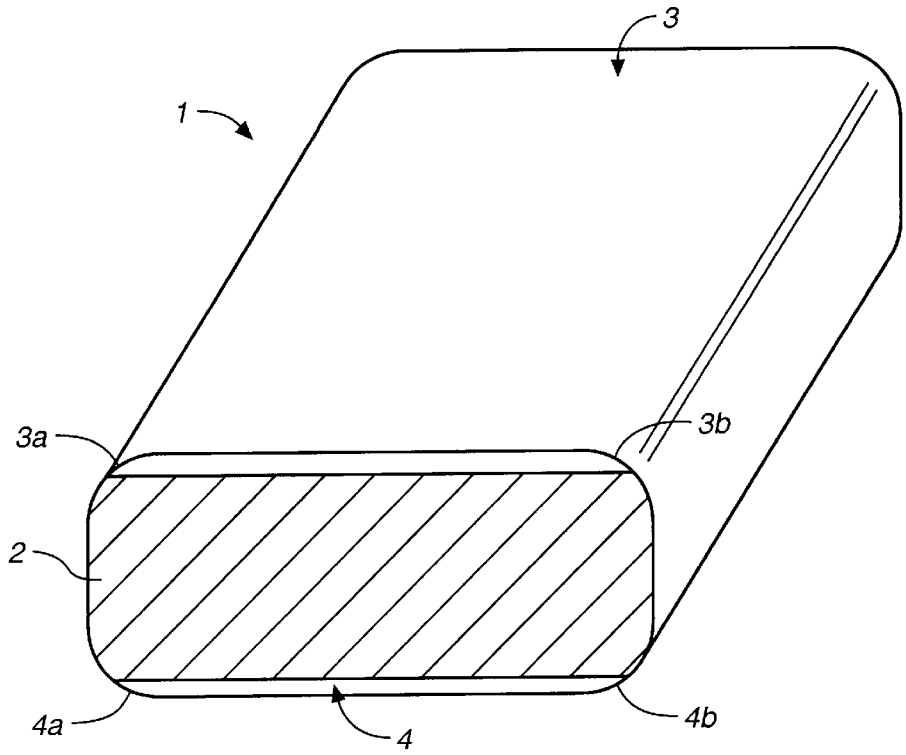
FIG. 1 is a schematic partially sectional diagonal view of an electronic device with an electrode abraded according to a method of this invention.
Figure 5:
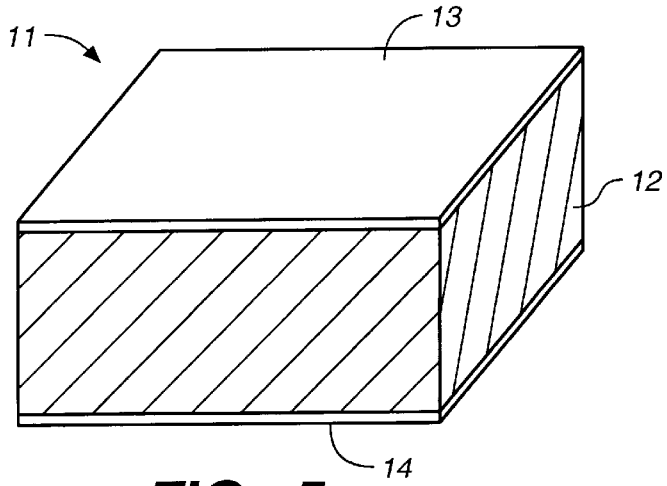
FIG. 5 (PRIOR ART)
FIG. 5 is a diagonal view of a prior art electronic device on which a method of this invention can be applied.

The condition of the barrel abrasion process are determined appropriately according to factors such as the amount of corrections to be effected and the dimensions of the thermistor elements. FIG. 1 shows a thermistor element 1 thus obtained after a barrel abrasion process, having electrodes 3 and 4 formed on the two main surfaces of a thermistor body 2 and end surfaces 3*a*, 3*b*, 4*a* and 4*b* of the electrodes 3 and 4 rounded off by the barrel abrasion process so as to reduce the electrode surface areas and to thereby increase its resistance value.

According to one embodiment of this invention, all thermistor elements in Group "C" are subjected to a same barrel abrasion process to have their resistance values increased. According to a preferred embodiment of the invention, Group "C" is divided further into several subgroups and a barrel abrasion process is carried out on each subgroup under different operating conditions according to the resistance values corresponding to the subgroup such that a more accurate correction work can be accomplished. Group "C" can be subdivided, for example, into Subgroup C1 with resistance value smaller than (R−a−x−y), Subgroup C2 with resistance value between (R−a−x−y) and (R−a−x) and Subgroup C3 with resistance value between (R−a−x) and (R−a). If the thermistor elements of Subgroups C1, C2 and C3 are abraded separately under different conditions, nearly all of the thermistor elements in Group C can be dependably "repaired," that is, their resistance values can be brought into the specified target range. It now goes without saying that less abrading will be required on those in Subgroup C3 than on those in Subgroup C2 and on those in Subgroup C2 than on those in Subgroup C1. It also goes without saying that this division into subgroups is done such that these subgroups will overlap one another at their boundaries.

It is to be appreciated that thermistor elements are designed for fabrication with target resistance value set to be lower than the center value R of the allowable range R±a because the number of thermistor elements in Group "B" having greater resistance values than the allowable range can thus be reduced. In this manner, the fraction of "good products" to be finally obtained can be increased according to this invention. Although the target resistance value was set at the lower limit (R−a) of the allowable range R±a in the example illustrated above, this is not intended to limit the scope of the invention. The target resistance value for the initial fabrication step has only to be set below the center of the allowable range and need not coincide with its lower limit (R−a).

It also goes without saying that when thermistor elements are originally obtained from a mother thermistor wafer, this process may be carried out with the aim towards having their resistance values falling within the allowable range R±a. If the process is carried out in this manner, the center of distribution of the resistant value will come closer to R and the fraction of the produced thermistor elements having a higher resistance value than R±a will be greater than in the case of the example described above but, since a greater fraction of thermistors with resistance values within the target range R±a can be obtained than by the conventional method, a higher ratio of acceptable products can be obtained by such a method.

Next, the invention is described by way of an actual test experiment carried out by the present inventors.

Thermistor elements with target resistance value of 10 KΩ and dimensions 50×50×0.5 mm having Ag electrodes formed on main surfaces of a thermistor body were cut from a mother thermistor wafer such that their resistance values would become 9.8 kΩ. The resistance values of these thermistor elements were measured, and the result shown by dotted line D in FIG. 3 was obtained. The thermistor elements were then divided into Subgroups E1–E5, defined as follows:

Subgroup E1: Resistance values less than 9.7 kΩ
Subgroup E2: Resistance values between 9.7 and 9.8 kΩ
Subgroup E3: Resistance values between 9.8 and 9.9 kΩ
Subgroup E4: Resistance values between 9.9 and 10.1 kΩ
Subgroup E5: Resistance values over 10.1 kΩ

Of the above, the thermistor elements in Subgroup E5 were discarded as being defective, while those in Subgroup E4 were treated as good products because their resistance values were within the allowable range preset to be 10±0.1 kΩ.

Figure 3:
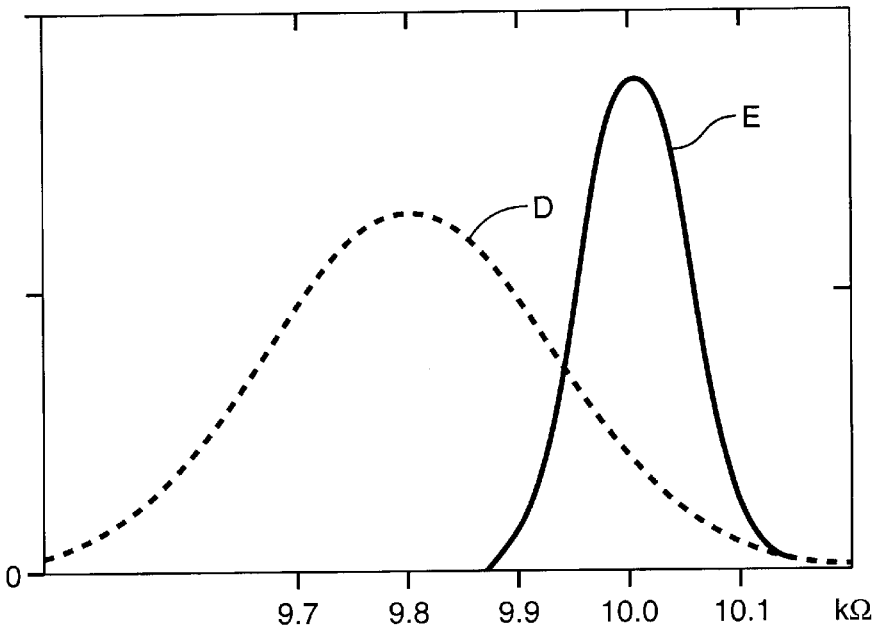
FIG. 3 is a graph of distributions in resistance value obtained before and after a repair process in a test example embodying this invention.

For repairing the thermistor elements in Subgroups E1–E3, 600±50 g of abrading particles with diameters 3–5 mm were placed inside the barrel of a polisher and repairing processes were carried out with 350±50 cc of water and by rotating the barrel at 220±40 rpm. The time for the process for each subgroup was as shown in Table 1. After the repair processes, the resistance values of the processed thermistor elements in Subgroups E1–E3 were measured. The result was as shown by solid line E in FIG. 3. FIG. 3 shows that almost all of the processed thermistors were within the allowable range of 10±0.1 kΩ. Table 1 also shows the correction rate by the repair process for each subgroup.

TABLE 1

| Group | E4 | E3 | E2 | E1 |
|---|---|---|---|---|
| Processing time (minute) | 0 | 40 | 80 | 110 |
| Fraction of correction (%) | 0.0 | 2.0 | 4.3 | 5.3 |

According to this test experiment by the present inventors, the fraction of defective products was about 60% before the repairing but this fraction could be reduced to less than 15% by carrying out the repair work as described above.

Figure 4A:
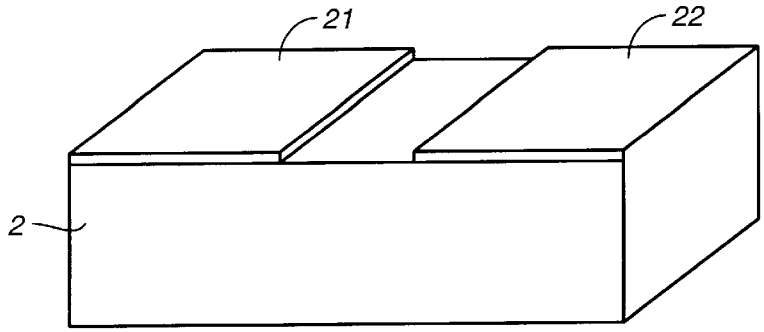
FIGS. 4A, 4B and 4C are diagonal side views of other electronic devices on which a method of this invention is applicable.
Figure 4B:
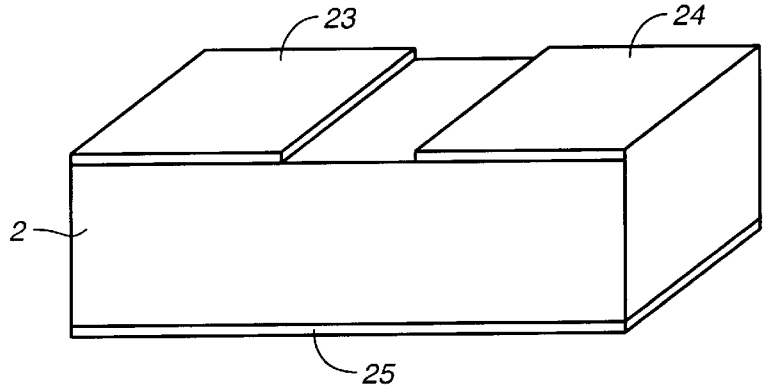
Figure 4C:
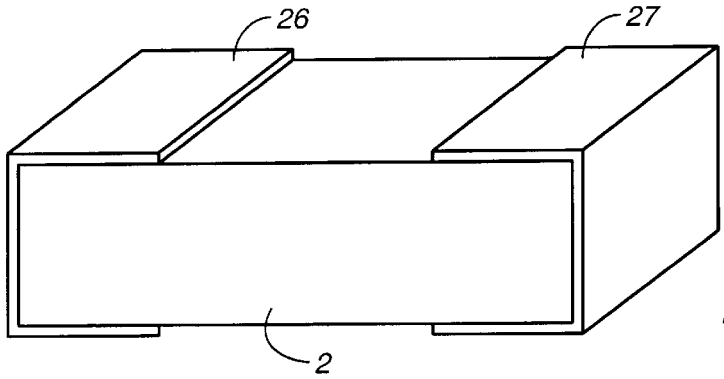

This invention is not limited to the type of thermistor elements to be produced, having electrodes formed on the two main surfaces of a thermistor body as shown in FIG. 1. This invention is applicable also to thermistor elements of the type as shown in FIG. 4A having mutually opposite electrodes 21 and 22 formed on one of the main surfaces of the thermistor body 2, the type as shown in FIG. 4B having both of a pair of mutually opposite electrodes 23 and 24 formed on one main surface and another electrode 25 on the other main surface, and also the type as shown in FIG. 4C having a pair of sectionally U-shaped electrodes 26 and 27 on both end surfaces of its thermistor body 2 and bent over also onto the two main surfaces.

It also goes without saying that this invention is not limited to the production of NTC thermistor elements. This invention is applicable also to the production of PTC thermistor elements, small ceramic resistors with little changes in their resistance values by temperature or those having internal electrodes in addition to external surface electrodes.

Although the invention was described above for a situation where many thermistor bodies are obtained by cutting a mother thermistor wafer, it is also applicable where ceramic bodies are obtained by first forming electrodes on the surface of an untreated ceramic body, cutting this into individual pieces and then sintering them, or where they are obtained by first cutting an untreated ceramic body, sintering them and then forming electrodes on these sintered pieces.

What is claimed is:

1. A method of producing electronic devices each with a resistance value within a specified allowable range, said method comprising the steps of:

preparing a plurality of electronic devices each having electrodes formed on a ceramic body, said plurality of electronic devices including those each having a resistance value below said allowable range;

measuring resistance value of each of said prepared electronic devices;

dividing said electronic devices into groups according to the magnitude of the measured resistance values, at least one of said groups being for resistance values below said allowable range;

selecting those of the measured electronic devices divided into said at least one group; and abrading at least one of the electrodes on each of the selected ones of said electronic devices.

2. The method of claim 1 wherein said at least one of the groups contains only those of said electronic devices with resistance values below said allowable range.

3. The method of claim 2 wherein said plurality of electronic devices that are prepared have a distribution of resistance values centered around said target resistance value.

4. The method of claim 3 wherein the step of abrading is effected on an edge surface of said at least one of the electrodes.

5. The method of claim 2 wherein the step of abrading is effected on an edge surface of said at least one of the electrodes.

6. The method of claim 1 wherein said plurality of electronic devices that are prepared have a distribution of resistance values centered around said target resistance value.

7. The method of claim 6 wherein the step of abrading is effected on an edge surface of said at least one of the electrodes.

8. The method of claim 1 wherein the step of abrading is effected on an edge surface of said at least one of the electrodes.

* * * * *